US005651313A

United States Patent [19]

Kowalewski et al.

[11] Patent Number: 5,651,313

[45] Date of Patent: Jul. 29, 1997

[54] PAPERBOARD PROCESSING MACHINE WITH VACUUM TRANSFER SYSTEM

[75] Inventors: James M. Kowalewski, Baltimore; Mikhail Elkis, Columbia; Leonard T. Katilas, Belcamp, all of Md.

[73] Assignee: Ward Holding Company, Inc., Wilmington, Del.

[21] Appl. No.: 564,563

[22] Filed: Nov. 29, 1995

Related U.S. Application Data

[63] Continuation-in-part of Ser. No. 311,063, Sep. 23, 1994, Pat. No. 5,509,352.

[51] Int. Cl.[6] ..... B41F 13/24

[52] U.S. Cl. ..... 101/232; 271/10.08; 271/94; 271/112; 271/197

[58] Field of Search ..... 101/230, 231, 101/232, 233, 234, 235, 236, 237, 238, 239, 240, 241, 242, 142, 183; 271/10.08, 10.1, 94, 96, 105, 111, 112, 3.07, 194, 197

[56] References Cited

U.S. PATENT DOCUMENTS

| | | | |
|---|---|---|---|
| 3,034,784 | 5/1962 | Lopez | 271/96 |
| 3,649,002 | 3/1972 | Burkhardt | 271/96 |
| 3,684,081 | 8/1972 | Matsuo | 101/232 |
| 4,831,419 | 5/1989 | Iaia, Jr. et al. | 271/197 |
| 5,048,812 | 9/1991 | Holmes | 271/112 |
| 5,383,392 | 1/1995 | Kowalewski et al. | 101/183 |
| 5,392,107 | 2/1995 | Paxon et al. | 271/197 |
| 5,464,202 | 11/1995 | Capedoseq | 271/11 |

*Primary Examiner*—Eugene H. Eickholt

*Attorney, Agent, or Firm*—Bartlett & Sherer

[57] ABSTRACT

A paperboard processing machine is disclosed for printing and otherwise processing sheets of paperboard, such as corrugated container blanks, and in which the sheets are conveyed from one section of the machine to another section by one or more vacuum transfer systems. Each vacuum transfer system comprises an enclosure which is closed by a closure plate for creating a subatmospheric pressure, which pressure forces the sheets into frictional engagement with the reaches of a plurality of conveyor belts whereby the sheets are transported without contact of the opposite side of the sheet not contacted by the conveyor reach.

4 Claims, 4 Drawing Sheets

PAPERBOARD PROCESSING MACHINE WITH VACUUM TRANSFER SYSTEM

This application is a Continuation-In-Part of application Ser. No. 08/311,063 filed Sep. 23, 1994, now U.S. Pat. No. 5,509,352.

FIELD OF THE INVENTION

This invention relates to machines for printing and otherwise processing sheets of paperboard, such as carton blanks and, more particularly, the present invention relates to a high-speed vacuum transfer conveyor system for transporting such carton blanks between adjacent processing sections of the machine.

BACKGROUND

In the printing of carton blanks, such as those composed of corrugated paperboard, for example, it is well known to apply ink impressions to the blanks with high speed flexographic rollers, and then to transport such inked carton blanks to the next section of the machine by the use of pull rollers which engage the upper and lower surfaces of the inked blanks. However, as the speeds of such machines have increased, and the quality of the ink impressions has become critical, a serious need has arisen to be able to transport the freshly inked blanks to the adjacent section of the machine without contacting the surface of the blank having the moist ink impression. In efforts to solve this problem, a number of transfer systems have been developed in which vacuum boxes are located between the upper and lower reaches of conveyors. The boxes have vacuum slots which communicate with vacuum apertures in the belts, such that, a partial vacuum pressure is applied to the blanks when the apertures in the belts are aligned with the slots in the vacuum boxes. One such system is described in co-pending application Ser. No. 08/033,097 now U.S. Pat. No. 5,383,392. Such systems are effective in transporting the carton blanks without contacting the inked surface; however, the force applied to the blanks is limited by the size of the apertures in the belts, and such apertures may not be made unduly large or they weaken the strength of the belt. Also, relatively low vacuum pressures are required and this, in turn, required relatively expensive vacuum pumps. Registration correction of the blanks is also made more difficult than if the belts did not require such vacuum apertures as will be further explained hereinafter.

A second type of transfer system, known as an open-flow system, has also been developed in which axial flow fans or blowers are utilized to create very large mass flows of air upwardly through a transfer zone between sections of the machine. Solid conveyor belts are provided in this transfer zone, and the high mass flow of air forces the blanks upwardly against the lower reaches of the conveyor as described in U.S. Pat. No. 5,163,891, or against a plurality of drive rollers as taught in U.S. Pat. No. 5,004,221. These systems eliminate the problems associated with the belt apertures; however, they require very high rates of mass flow which can create problems of excessive dust-flow within the machine, as well as undesirable noise and vibration levels.

SUMMARY

The present invention solves all of the above problems by providing an enclosed space of subatmospheric pressure through which solid conveyor belts extend, and enclosing the bottom of such space with a solid, impervious closure plate, with only restricted-flow openings into the subatmospheric space which are located adjacent the entrance and exit ends of the conveyors. As a result, the vacuum apertures in the belts are eliminated, and only relatively low air flows are required. These and other objects of the invention will become apparent from the following description of one preferred embodiment illustrated in the following drawings.

DETAILED DESCRIPTION

Figure 1:
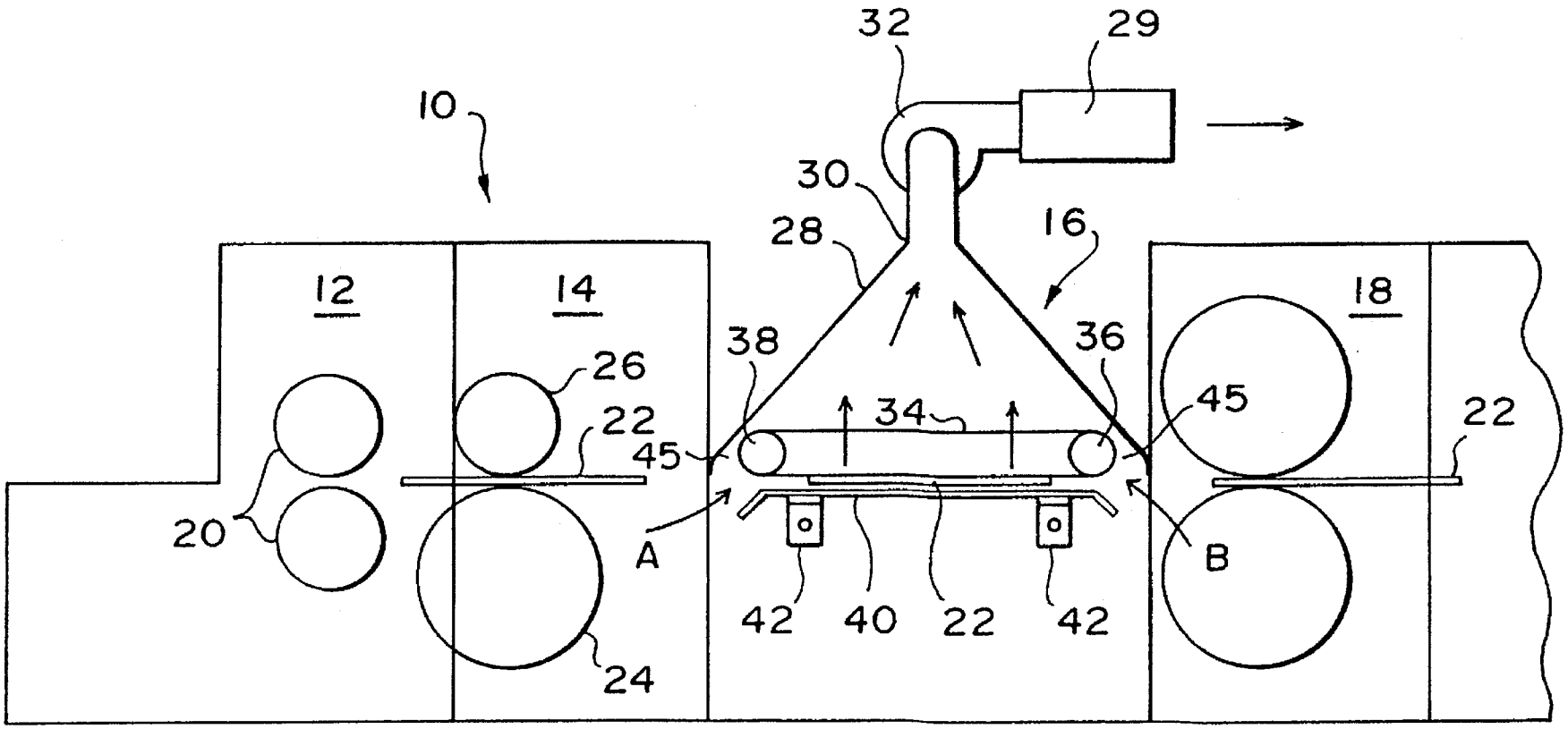
FIG. 1 is a schematic side view of the machine.

Referring first to FIG. 1, a carton blank printing and processing machine 10 is shown schematically as comprising a feed section 12, a printing section 14, a transfer section 16, and at least one further downstream processing section, such as a die cutter section 18, for example. Of course, it will also be understood that other downstream sections may also be present such as tab cutting and glue/folding sections not shown. Feed rollers 20 feed carton blanks 22, sometimes referred to herein as sheets, from feed section 12 to printing section 14 in which the blanks pass between a print roll 24, and an impression roll 26. From printing section 14 the carton blanks 22 may pass to additional printing sections (not shown), or as shown in the simplified illustration of FIG. 1, the blanks pass to a transfer section 16 which conveys the blanks to die cutter section 18, or to such other processing section as may be adjacent the last stage of the printing section.

The primary purpose of providing an elongated transfer section, as opposed to providing feed rolls for passing the blanks directly from the printing section to the adjacent section, is to provide additional time for the ink impressions on the blanks to dry more completely before entering the next section. In the illustrated embodiment, it will be apparent that the wet ink is on the bottom sides of the carton blanks coming off print roll 24 such that it is desired to have air flow, and possibly radiant heat, directed at the bottom sides of the blanks. However, the bottom sides of the blanks must not be otherwise contacted during passage through the transfer/drying section 16 lest the ink impressions be smeared.

Figure 2:
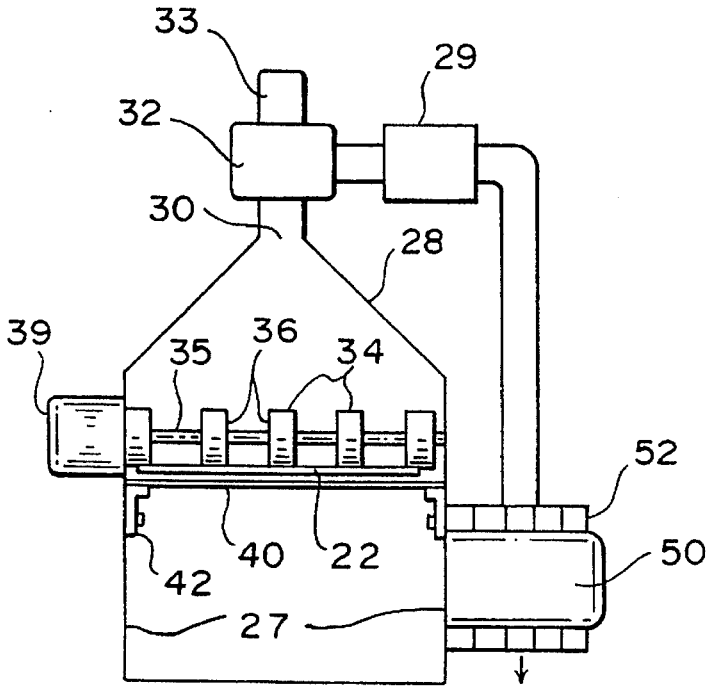
FIG. 2 is a schematic end view of the machine.

To effect such transport of the carton blanks, as illustrated schematically in the preferred embodiment of FIGS. 1 and 2, the present invention mounts a hood 28 with its bottom edges secured to side walls 27. Hood 28 is generally in the shape of a pyramid, with an air-flow outlet 30 at the top connected to the inlet of a blower 32, which may be driven by a variable speed motor 33. Blower 32 is preferably of the center inlet-peripheral discharge type or vaneaxial type, and preferably discharges through a sound attenuator 29. At the bottom edge of hood 28, a plurality of horizontally extending conveyor belts 34 are mounted on drive pulleys 36 and idler pulleys 38; drive pulleys 36 being driven by motor 39 through shaft 35 as illustrated in FIG. 2. The front and rear bottom edges of the hood are positioned close to pulleys 36 and 38, such as in the order of one inch or less, and the bottom of the side edges extend down to or slightly below the line of travel of the blanks so as to fully surround the conveyors. The entire bottom of the hood is closed by an impervious plate 40 which extends the full width of the hood and extends to or beyond the front and rear turnarounds of the belts.

With the almost completely enclosed hood-and-plate structure just described it will be understood that, when blower 32 is operating, a subatmospheric pressure is created within hood 28, and the only path for the flow of atmospheric air into the hood is the severely restricted slotted openings between the plate and the bottom edges of the hood at the inlet and exit ends of the transfer section as shown by arrows A and B. This creates a substantial pressure differential between the bottom and top sides of the blanks, as will be more fully described hereinafter, such that the blanks are forced upwardly against the bottom reaches of the conveyor belts. The surfaces of the belts are composed of a material having a high coefficient of friction such that the blanks are forced into firm frictional contact with the bottom reaches of the belts. Thus, the blanks may be transported through the transfer/dryer section, which may be in the order of 3 to 5 feet in length, without slippage, and at very high speeds such as in the order of 1,000 feet per minute.

In understanding the fluid dynamics of the present invention, it is to be noted that the provision of baffle or closure plate 40 is of particular significance in that it not only effectively closes the bottom of the hood, thereby substantially reducing the mass-flow which must be effected by the blower, but in addition, plate 40 creates a relatively dead-air zone immediately below the blanks. That is, as each blank moves through the transfer section, there is only a nominal clearance space between the bottom surface of the blank and the top surface of the closure plate; such clearance space being in the order of ¼ to 1 inch. In this restricted clearance zone, the air under each blank is in communication with atmospheric air at both ends and both sides of the blank such that the pressure of the air in this restricted clearance zone is essentially full atmospheric pressure whereby the maximum possible pressure is exerted upwardly against the bottom surface of the blank. Thus, closure plate 40 makes it possible to obtain very tight adherence of the blank against the belts, and by substantially reducing the mass-flow which would otherwise be required to achieve this high level of adherence. In this regard, while the preferred embodiment illustrates the use of a centrifugal blower, or a vaneaxial fan may be used, it is to be understood that an axial flow fan may also be used. However, it has been discovered that a centrifugal blower or vaneaxial fan is greatly preferred because pure axial flow fans require the movement of massive amounts of air in order to create the desired degree of subatmospheric pressure in the hood; such subatmospheric pressure being, for example, in the range of 2 go 4 inches of water. This is highly undesirable in the environment of a printing machine because such massive volumes of air movement can create dust problems which may contaminate the ink impressions, as well as causing excessive noise and vibrations. Thus, the combination of a centrifugal blower with an essentially closed hood has been discovered to provide the necessary degree of subatmospheric pressure with substantially lower, more acceptable mass flow and power requirements.

Referring back to FIG. 2, after the exhaust air passes through sound attenuator 29, the preferred embodiment of the present invention provides the further improvement of cooling one or more of the motors. The motor may be motor 50 which drives the print rolls, and/or the motor driving the die cutter rolls or the transfer belts. This cooling is performed bypassing the exhaust air from blower 32 through a finned jacket 52 which surrounds the motor(s). In this manner, the previously required water-cooled jackets and expensive liquid cooling pumps may be eliminated; thereby further reducing the power requirements of the total system.

The present invention also simplifies the system required for registration correction of the blanks in that, since the belts of the present invention do not require vacuum apertures, a registration correction may be made as taught, for example, in copending application Ser. No. 08/033,097 (now U.S. Pat. No. 5,383,392) without the added requirement to correct the linear position of the belts thereafter as disclosed, for example, in co-pending application Ser. No. 08/308,845.

Figure 3:
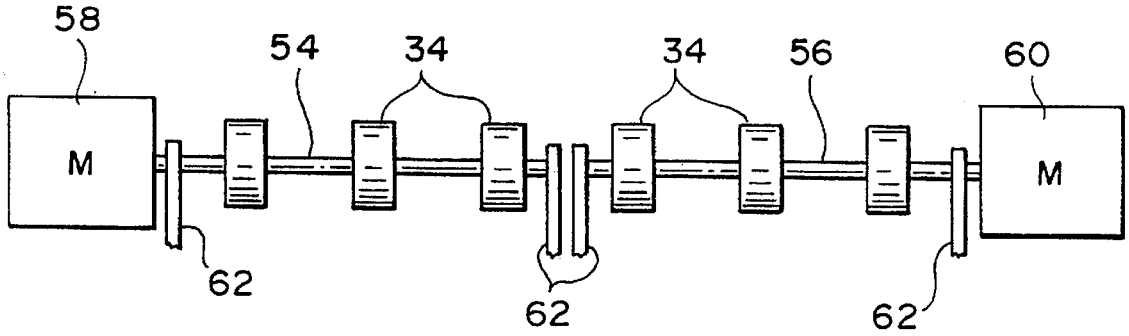
FIG. 3 is an enlarged schematic view of the conveyor and motor structure.

The present invention also facilitates skew correction in that belts 34 do not require vacuum apertures such that the belts on one side of the longitudinal center of the machine may be speeded up or retarded relative to the other side. This is illustrated in FIG. 3 wherein drive shaft 35 is replaced by two separate drive shafts 54 and 56, each driven by a separate servo motor 58, 60; shafts 54, 56 being supported by suitable support bars 62 and bearings not shown. As a result, skew correction may be accomplished by increasing the speed of one of the drive shafts relative to the other, and then returning the speed of that shaft to that of the other shaft once the skew of that particular blank has been eliminated.

Figure 4:
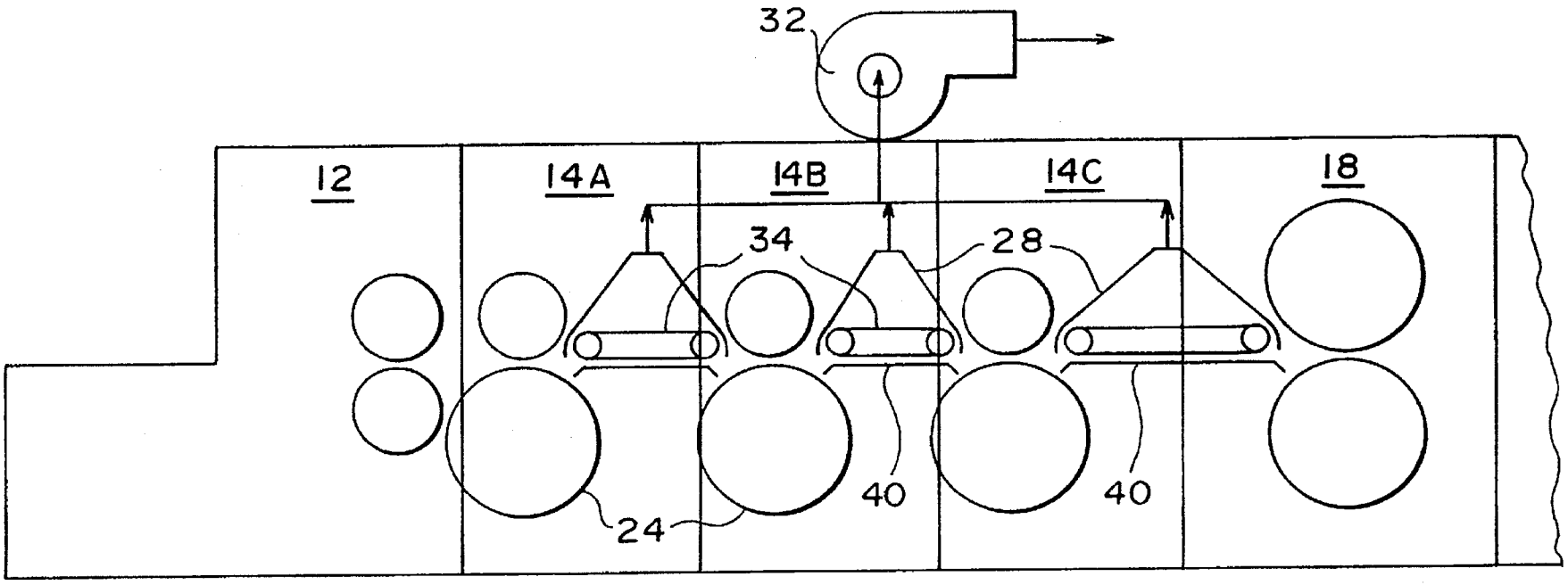
FIG. 4 is a schematic side view of a second embodiment of the present invention.

In addition to the use of transfer section 16 between the printing section and the adjacent processing section, the transfer section of the present invention may be used between any two adjacent processing sections such as, for example, between the die cutter section and an adjacent glue/folder section, slotter section, or other section. Furthermore, it has been discovered that the transfer section of the present invention may be used between multiple printing sections, as illustrated schematically in FIG. 4, thereby eliminating the expensive feed rolls and controls, and also separate the dynamic feed and cutter sections from the steady state printing function. The components of the transfer systems in FIG. 4 are the same as those previously described, and are noted with the same numerals, except that the lengths of the systems are significantly shorter; ie, in the order of 1 to 2 feet so as to fit between adjacent print rolls. Also, because of their small size, two or more of the hoods 28 may be manifolded to a single blower 32 if desired.

Figure 5:
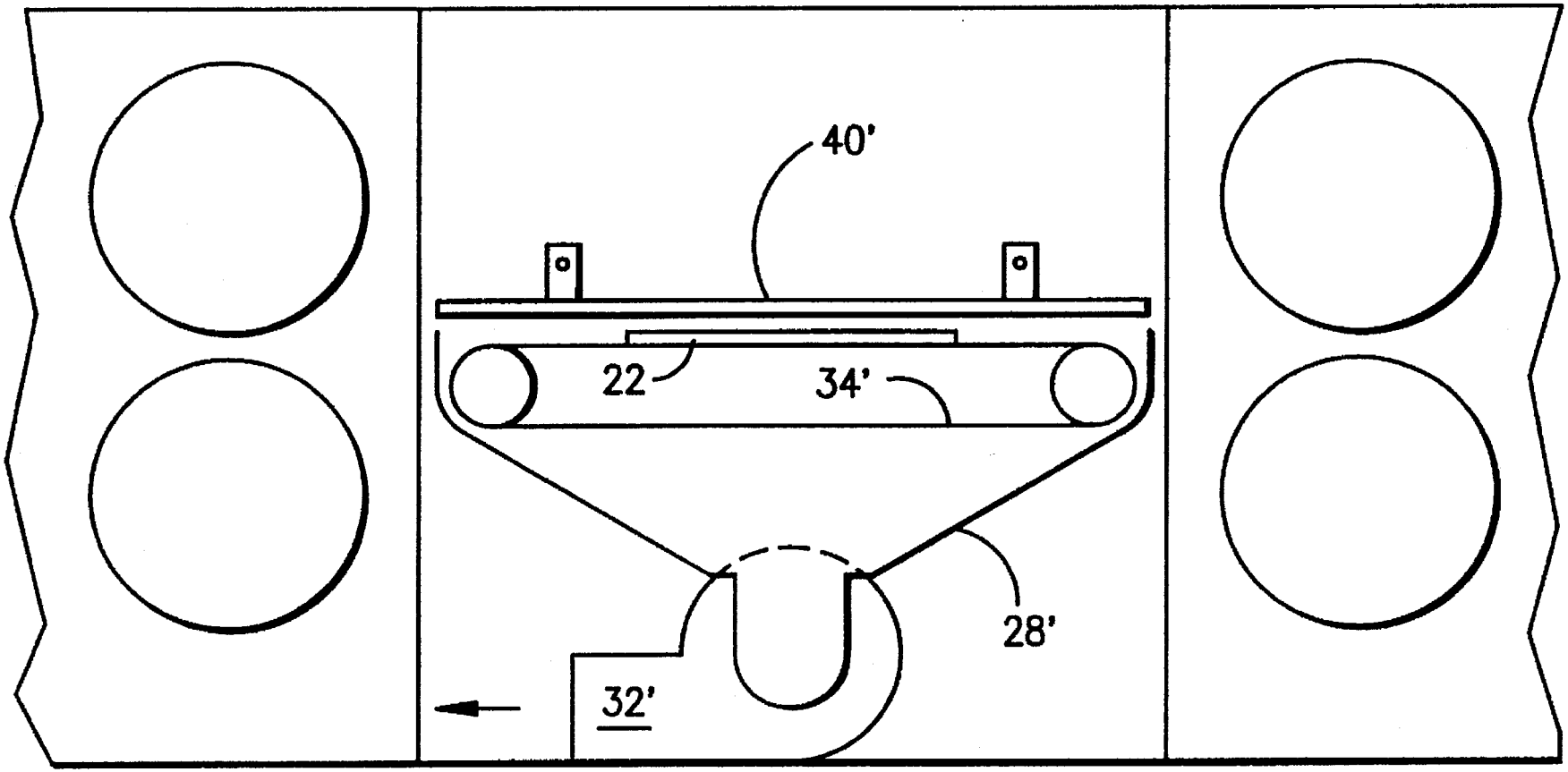
FIG. 5 is a schematic side view of a third embodiment of the invention.

From the foregoing description it will be apparent that the present invention achieves high speed transport of sheets from one location to another by forcing the sheets upwardly against moving belts, without requiring vacuum holes in the belts, and with the expenditure of substantially less power than previously required. It will also be understood that, instead of the sheets being forced upwardly against the belts, the system may be inverted as shown in FIG. 5 with the suction hood 28' located below belts 34' such that sheets 22 are pulled down against the upper reaches of the belts. These and other variations will become apparent to those skilled in the art such that it is to be expressly understood that the foregoing description is intended to be illustrative of the principles of the invention, rather than exhaustive thereof, and that the true scope of the present invention is not intended to be limited by the description of the preferred embodiments, nor limited other than as set forth in the following claims interpreted under the doctrine of equivalents.

What is claimed is:

1. A machine for printing and otherwise processing corrugated carton blanks comprising:

(a) a printing section;

(b) an adjacent processing section;

(c) a transfer section located between said sections;

(d) said transfer section comprising a plurality of parallel conveyor belts having solid upper and lower reaches extending from adjacent said printing section to adjacent said processing section for transferring said blanks from said printing section to said processing section, said belts having first ends adjacent said printing section and second ends adjacent said processing section;

(e) a hood positioned below said lower reaches of said plurality of conveyor belts, said hood having an open portion surrounding said conveyor belts;

(f) a solid closure plate extending horizontally above said upper reaches of said conveyor belts, said plate being of such size and shape such as to substantially close said open portion of said hood and provide restricted air inlet openings positioned adjacent said first and second ends of said conveyors;

(g) said hood having an opening below said conveyor belts for the flow of air out of said hood so as to create a subatmospheric pressure within said hood surrounding said conveyor belts; and (h) air flow inducing means for drawing air out of said hood through said opening and creating said subatmospheric pressure surrounding said conveyor belts such that said corrugated carton blanks located above said upper reaches of said conveyor belts and below said closure plate are forced downwardly into frictional engagement with said upper reaches of said conveyor belts and are transported by said upper reaches from said printing section to said processing section.

2. The printing a paperboard processing machine of claim 1 wherein said machine comprises at least first and second printing sections and an adjacent processing section, and wherein a transfer section is located between each of said sections.

3. The carton blank processing machine of claim 1 wherein said hood comprises an enclosure which extends below said lower conveyor reach and extends upwardly to a position adjacent the upper reach of said conveyor belts, and wherein said closure plate closes the open top of said enclosure except for said restricted air inlet openings at the ends of said conveyor belts for the passage of carton blanks through such restricted openings.

4. The carton blank processing machine of claim 1 wherein said restricted air inlet openings are of a size such as to reduce the mass-flow of air through said restricted openings such as to prevent the flow of unacceptable amounts of dust into contact with said carton blanks.

* * * * *